US005232122A

United States Patent [19]

Garrigue

[11] Patent Number: 5,232,122

[45] Date of Patent: Aug. 3, 1993

[54] DEVICE FOR AUTOMATICALLY DISPENSING LABELS FROM A CONTINUOUS STRIP

[75] Inventor: André Garrigue, Courbevoie, France

[73] Assignee: Alcatel Satman, Bagneux, France

[21] Appl. No.: 939,712

[22] Filed: Sep. 2, 1992

[30] Foreign Application Priority Data

Sep. 9, 1991 [FR] France ..... 91 11110

[51] Int. Cl.[5] ..... B65H 5/28

[52] U.S. Cl. ..... 221/71; 221/70

[58] Field of Search ..... 221/69, 70, 71, 72

[56] References Cited

U.S. PATENT DOCUMENTS 4,637,523 1/1987 Levasseur ..... 221/71 X 5,102,008 4/1992 Kaufman et al. ..... 221/72 X

FOREIGN PATENT DOCUMENTS 0202486 11/1986 European Pat. Off. .

2607470 6/1988 France .

665407 5/1988 Switzerland .

1156663 7/1969 United Kingdom .

*Primary Examiner*—Robert P. Olszewski

*Assistant Examiner*—Dean A. Reichard

*Attorney, Agent, or Firm*—Sughrue, Mion, Zinn, Macpeak & Seas

[57] ABSTRACT

A device automatically dispenses labels from a continuous strip. It constitutes a compact module comprising at least three parts hinged together including an upper flap and a main guide part and a lower guide part which cooperate with each other to form a guide path whose strip entry axis is offset angularly (twistwise) from the label exit axis. The three parts carry a strip guide path, a cutting device, an intermittent strip feed, strip and label sensor, a drive for the feed and the cutting device, and a device for ejecting each cut label.

6 Claims, 3 Drawing Sheets

DEVICE FOR AUTOMATICALLY DISPENSING LABELS FROM A CONTINUOUS STRIP

BACKGROUND OF THE INVENTION

1. Field of the invention

The present invention concerns a device for automatically distributing variable length labels from a spooled continuous strip.

2. Description of the prior art

The present invention is more particularly concerned with a device for automatically dispensing labels from a continuous strip comprising:

a strip guide path, cutting means mounted on said path, intermittent strip feed means mounted on said path relative to the cutting means to hold the strip simultaneously on the entry side and on the exit side of the cutting means and to feed it at a given speed, strip and label sensing means mounted on said path on the exit side of the cutting means and comprising a first sensor at a distance from the cutting means equal to a short label length and assigned to sensing an initial position of the strip on the path and a second sensor mounted at a distance from the cutting means equal to a long label length and assigned to sensing further feeding of the strip on the path from said initial position prior to actuation of the cutting means to cut each label to the required length, drive means for said feed means and said cutting means connected to said sensors and comprising an input receiving a short label/long label selector signal and initiating corresponding label dispensing sequences according to the signal sensing said initial position of the strip and the signal sensing the rest position of the cutting means, means for ejecting each cut label at a speed greater than said feed speed mounted on the exit side of the first sensor and separated from the feed means by a distance less than the short label length.

A dispenser of this kind is described in European Pat. No. 202 486 filed 22 Apr. 1986.

Label dispensers of this kind are not particularly compatible with compact modular franking machines. They do not always provide easy access to the label path for clearing a jam or for routine maintenance, for example. They often require a special arrangement to link the label and envelope paths at their outlet.

An object of the present invention is to propose an automatic label dispenser designed in particular to be fitted as a module to a franking machine and which solves the aforementioned problem whilst being simple, reliable and economical.

SUMMARY OF THE INVENTION

The present invention consists in a device for automatically dispensing labels from a continuous strip comprising:

a strip guide path, cutting means mounted on said path, intermittent strip feed means mounted on said path relative to said cutting means to hold said strip simultaneously on the entry side and on the exit side of said cutting means and to feed it at a given speed, strip and label sensing means mounted on said path on the exit side of said cutting means and comprising a first sensor at a distance from said cutting means equal to a short label length and assigned to sensing an initial position of said strip on said path and a second sensor mounted at a distance from said cutting means equal to a long label length and assigned to sensing further feeding of said strip on said path from said initial position prior to actuation of said cutting means to cut each label to the required length, drive means for said feed means and said cutting means connected to said sensors and comprising an input receiving a short label/long label selector signal and initiating corresponding label dispensing sequences according to the signal sensing said initial position of said strip and the signal sensing the rest position of said cutting means, means for ejecting each cut label at a speed greater than the feed speed mounted on the exit side of said first sensor and separated from said feed means by a distance less than said short label length, said device constituting a compact module comprising at least three parts hinged together including an upper flap and a main guide part and a lower guide part which cooperate with each other to form said guide path whose strip entry axis is offset angularly from the label exit axis.

Access to the label path is therefore facilitated and the usual linking of separate label and envelope paths at the dispenser outlet is done away with.

In a preferred embodiment:

the lower part is adapted to be attached to a fixed base, the main part is hinged to the lower part about a substantially horizontal axis, the flap is hinged to the main part about an axis substantially parallel to the upper surface of the main part.

In a preferred embodiment the main part carries:

rollers forming said feed means, said cutting means, at least one roller forming said ejector means, mechanical sensors forming said sensing means, motors constituting said drive means.

To cooperate with a main part of this kind, said flap preferably carries rollers adapted to cooperate with the rollers of the main part forming the feed means, and/or the lower part carries at least one roller adapted to cooperate with the roller(s) of the main part forming the ejector means.

The invention is explained in more detail hereinafter with reference to drawings showing one embodiment of the invention.

DETAILED DESCRIPTION OF THE INVENTION

Figure 1:
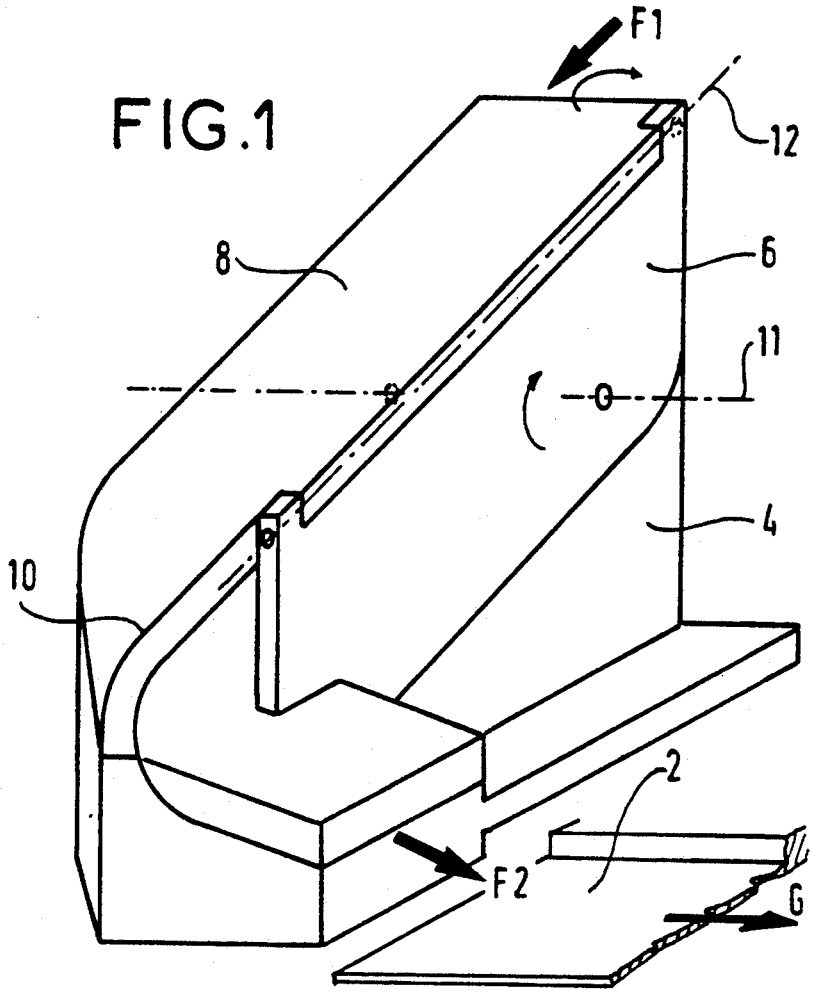
FIG. 1 is a diagrammatic perspective view of a dispenser in accordance with the invention in a closed position.
Figure 2:
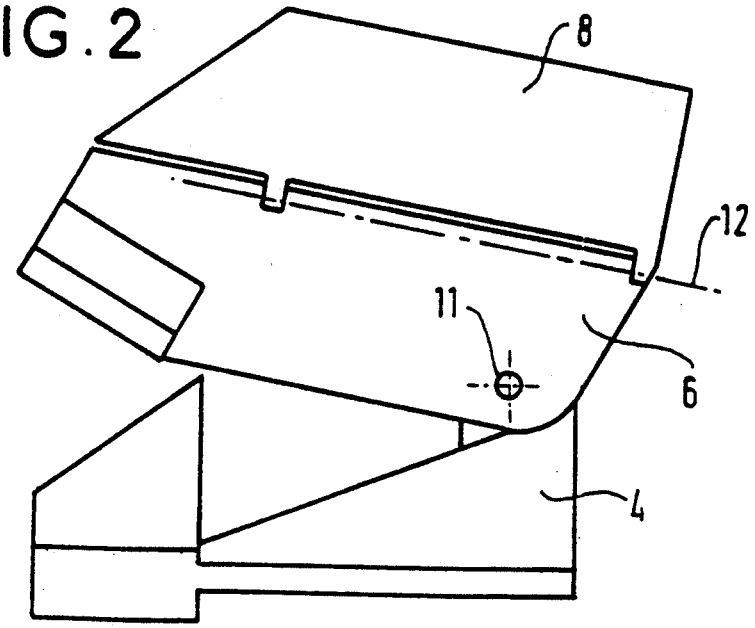
FIG. 2 is a diagrammatic side view of this dispenser in an open position.

FIGS. 1 and 2 show an automatic label dispenser in accordance with the invention for dispensing labels from a continuous strip.

It is in the form of a compact module comprising three parts hinged together, namely an upper flap 8, a main guide part 6 and a lower guide part 4. The latter cooperate with each other to form the guide path whose strip entry axis (arrow F1) is offset angularly (twistwise) from the label exit axis (arrow F2). In the preferred embodiment this angular offset is 90°.

The lower part 4 is adapted to be attached to a fixed base, for example by two pegs attached to its lower surface which clip into two housings provided on the base of a franking machine.

The lower part 4 guides the lower surface of the label from the generatrix of the twist part 10 to the exit to the franking machine (arrow F2).

The main part 6 is hinged to the lower part 4 about a substantially horizontal axis 11. The part 6 guides the lower surface of the label from its entry (arrow F1) to the exit (arrow F2) to the franking machine, including in the twist part 10.

The flap 8 is hinged to the main part 6 about an axis 12 substantially parallel to the upper surface of the main part 6. It guides the upper surface of the label from the entry (arrow F1) to the twist generatrix.

FIG. 1 also shows the associated table 2 from which envelopes are fed into the franking machine. The arrow G represents the axis of the envelope path and the direction in which the envelopes move.

Figure 3:
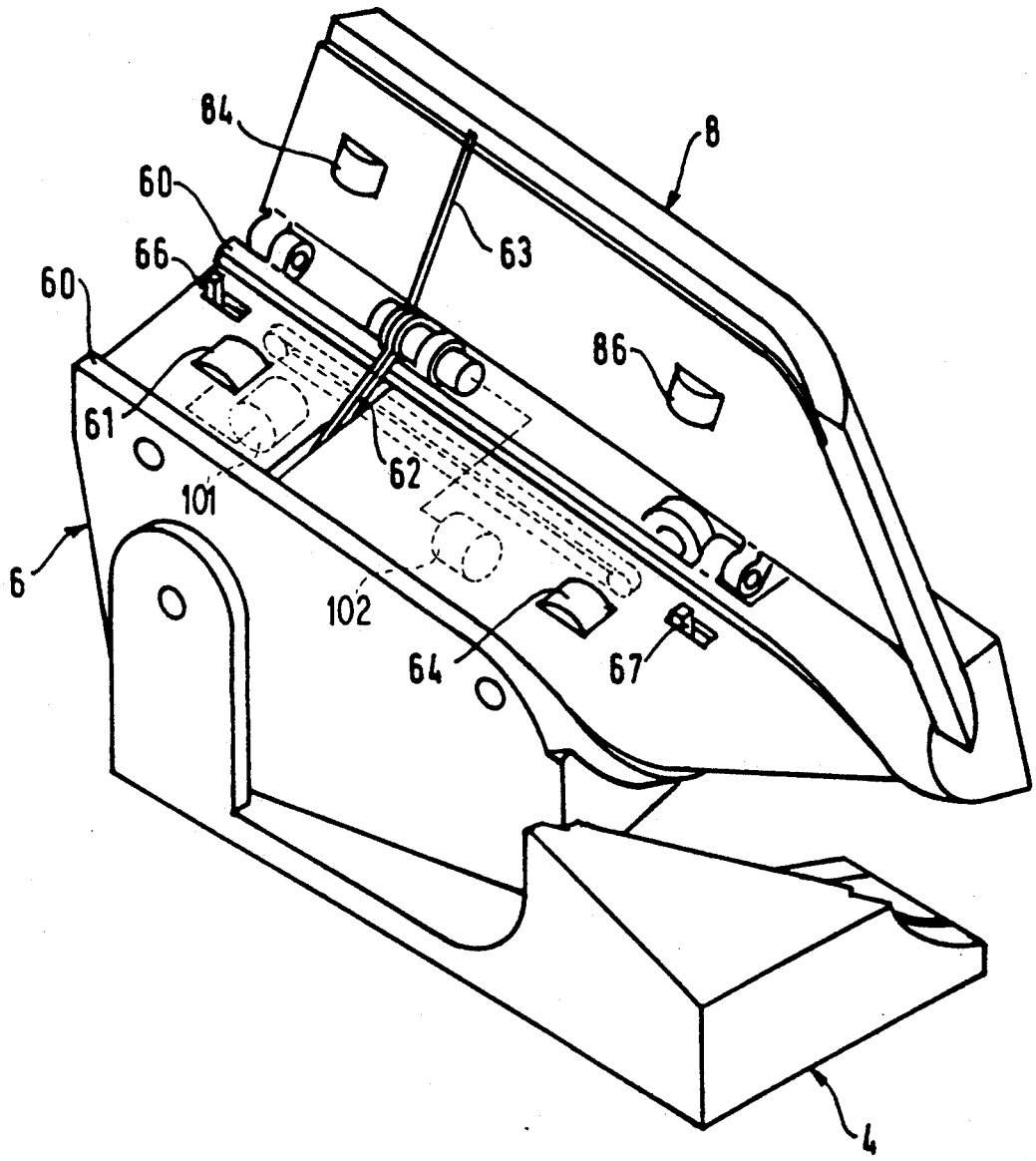
FIG. 3 is a perspective top view of the preferred embodiment of the device in the open position.
Figure 4:
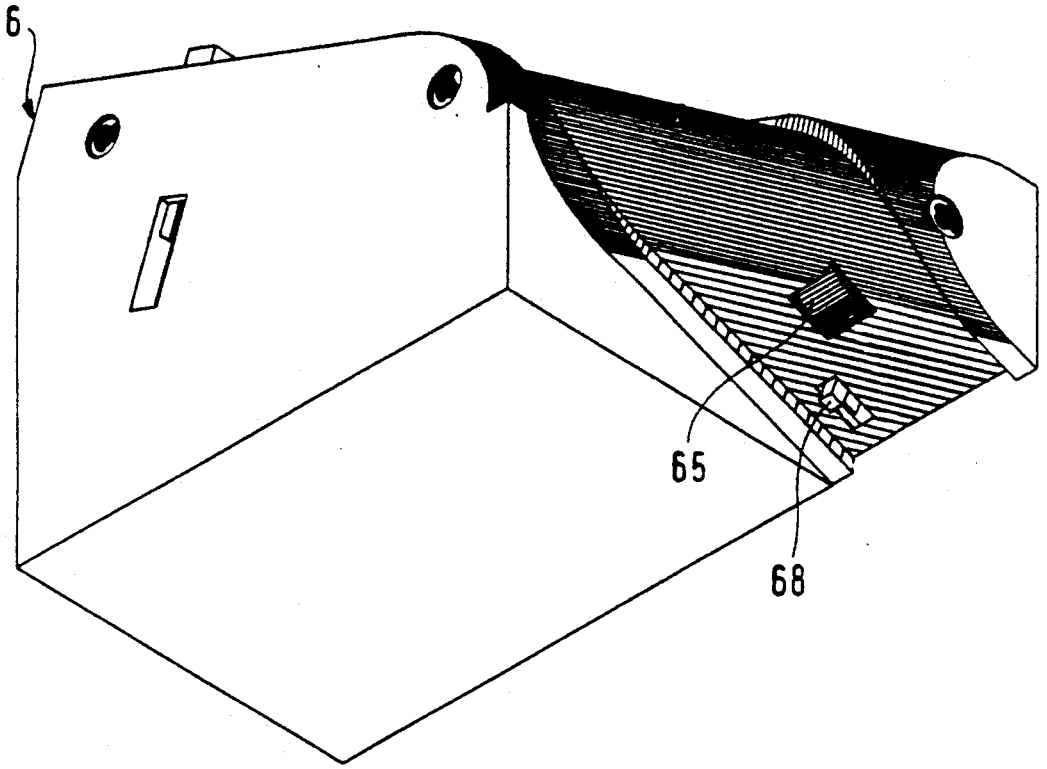
FIG. 4 is a partial bottom perspective view of the preferred embodiment of the device.

The dispenser is shown in FIGS. 3 and 4, the latter showing only the part 6.

The main part 6 comprises two fixed or adjustable lateral guides 60 delimiting the guide path and carries:

the cutting means comprising blades 62 and 63 articulated about the axis 12 scissors-fashion, rollers 61 and 64 forming intermittent feed means for the strip mounted on the path relative to the cutting means 62, 63 to hold the strip simultaneously on the entry and exit sides of the latter and to feed it at a given speed, mechanical sensors 66, 67, 68 forming the strip and label sensing means, one of which (66) is mounted on the entry side of the cutting means 62, 63 and senses the end of the strip and the other two of which (67, 68) are mounted on the path on the exit side of the cutting means 62, 63, the first sensor 67 being at a distance from the cutting means equal to a short label length and assigned to sensing an initial position of the strip on its path and the second sensor 68 being mounted at a distance from the cutting means equal to a long label length and assigned to sensing further advance of the strip along its path from the initial position prior to actuation of the cutting means so that each label can be cut to the required length, at least one roller 65 forming means for ejecting each label at a speed greater than the feed speed mounted on the exit side of the first sensor 67 and separated from the drive means 61, 64 by a distance less than the short label length, and motors 100 constituting drive means for the feed means 61, 64 and the cutting means 62, 63 connected to said sensors 66, 67, 68 having an input receiving a short label/long label selector signal and initiating corresponding label dispensing sequences according to the signal sensing the initial position of the strip and the signal sensing the rest position of the cutting means.

The flap 8 carries rollers 84, 86 cooperating with the rollers 61, 64 of the main part 6.

The lower part 4 carries at least one roller (not shown) cooperating with the roller(s) 65 of the main part 6.

The strip magazine (not shown) comprises two areas spaced apart by idler rollers, for example. It is disposed on the entry side of the dispenser and the external side of the spool rests on the generatrices of the two rollers.

There is claimed:

1. Device for automatically dispensing labels from a continuous strip comprising:

a strip guide path, cutting means mounted on said path, intermittent strip feed means mounted on said path relative to said cutting means to hold said strip simultaneously on an entry side and on an exit side of said cutting means and to feed it at a given speed, strip and label sensing means mounted on said path on the exit side of said cutting means and comprising a first sensor at a distance from said cutting means equal to a short label length and assigned to sensing an initial position of said strip on said path and a second sensor mounted at a distance from said cutting means equal to a long label length and assigned to sensing further feeding of said strip on said path from said initial position prior to actuation of said cutting means to cut each label to the required length, drive means for said feed means and said cutting means connected to said sensors and comprising an input receiving a short label/long label selector signal and initiating corresponding label dispensing sequences according to the sensing means sensing said initial position of said strip and the sensing means sensing the rest position of said cutting means, and means for ejecting each cut label at a speed greater than the feed speed mounted on an exit side of said first sensor and separated from said feed means by a distance less than said short label length, said device constituting a compact module comprising at least three parts hinged together including an upper flap and a main guide part and a lower guide part which cooperate with each other to form said guide path whose strip entry axis is offset angularly from a label exit axis.

2. Device according to claim 1 wherein:

said lower part is adapted to be attached to a fixed base, said main part is hinged to said lower part about a substantially horizontal axis, and said flap is hinged to said main part about an axis substantially parallel to the upper surface of said main part.

3. Device according to claim 1 wherein said main part carries:

rollers forming said feed means, said cutting means, at least one roller forming said ejector means, mechanical sensors forming said sensing means, and motors forming said drive means.

4. Device according to claim 3 wherein said flap carries rollers adapted to cooperate with said rollers of said main part forming said feed means.

5. Device according to claim 3 wherein said lower part carries at least one roller adapted to cooperate with said roller(s) of said main part forming said ejector means.

6. Device according to claim 1 wherein said cutting means comprise two blades hinged together scissors-fashion.

* * * * *